US010751233B1

(12) United States Patent
Walker

(10) Patent No.: US 10,751,233 B1
(45) Date of Patent: Aug. 25, 2020

(54) FOLDABLE MULTI-PURPOSE WHEELCHAIR

(71) Applicant: Deborah Walker, Wilson, NC (US)

(72) Inventor: Deborah Walker, Wilson, NC (US)

( * ) Notice: Subject to any disclaimer, the term of this patent is extended or adjusted under 35 U.S.C. 154(b) by 0 days.

(21) Appl. No.: 16/432,149

(22) Filed: Jun. 5, 2019

(51) Int. Cl.
*A61G 5/08* (2006.01)
*A61G 5/10* (2006.01)
*A61G 5/12* (2006.01)

(52) U.S. Cl.
CPC ..... *A61G 5/0891* (2016.11); *A61G 5/085* (2016.11); *A61G 5/0866* (2016.11); *A61G 5/1002* (2013.01); *A61G 5/1048* (2016.11); *A61G 5/125* (2016.11)

(58) Field of Classification Search
CPC combination set(s) only.
See application file for complete search history.

(56) References Cited

U.S. PATENT DOCUMENTS 2,745,112 A * 5/1956 Bindbeutel ..... A61G 5/1002 4/483
3,123,398 A * 3/1964 Murcott ..... A61G 5/1002 297/183.7
6,086,086 A * 7/2000 Hanson ..... A61G 5/0891 280/650
6,183,002 B1 * 2/2001 Choi ..... A61G 5/045 280/647
6,416,070 B1 * 7/2002 Lin ..... A61G 5/10 280/250.1
6,418,571 B1 * 7/2002 Cheng ..... A47K 11/04 297/188.09
10,543,144 B2 * 1/2020 Johnson ..... A61H 3/04
10,595,682 B2 * 3/2020 Racanelli ..... A47C 7/02
2002/0024196 A1 * 2/2002 Malassigne ..... A61G 5/125 280/648
2002/0050697 A1 * 5/2002 Hallgrimsson ..... A61G 5/0891 280/87.051
2008/0036181 A1 * 2/2008 Goldstein ..... A61G 7/1059 280/648
2008/0042474 A1 * 2/2008 Dickie ..... A61G 5/085 297/16.2
2008/0078015 A1 * 4/2008 Jarosinski ..... A47K 11/04 4/480
2008/0079230 A1 * 4/2008 Graham ..... A61G 5/0816 280/87.041
2008/0129016 A1 * 6/2008 Willis ..... A61G 5/08 280/639
2008/0265548 A1 * 10/2008 Hammer ..... A61G 5/0883 280/650
2011/0258771 A1 * 10/2011 Hammer ..... A61G 5/1075 4/667

(Continued)

*Primary Examiner* — Erez Gurari
(74) *Attorney, Agent, or Firm* — Sanchelima & Associates, P.A.; Christian Sanchelima; Jesus Sanchelima

(57) ABSTRACT

A multi-purpose wheelchair is disclosed herein. The wheelchair comprises a tubular frame having two support members pivotally mounted and extending upwardly from the tubular frame. The wheelchair also comprises four legs pivotally mounted and extending downwardly from the tubular frame. The wheelchair comprises further four wheels arranged such that one wheel is provided with each of the legs. The wheelchair also comprises a split-seat with an opening supported on the base. Further, the wheelchair comprises a back support extending between the two support members.

13 Claims, 2 Drawing Sheets

(56) References Cited

U.S. PATENT DOCUMENTS

| | | | | |
|---|---|---|---|---|
| 2012/0030870 | A1* | 2/2012 | Storm | A61G 5/1002 4/578.1 |
| 2012/0205882 | A1* | 8/2012 | Staggs | A61G 5/1002 280/30 |
| 2014/0208493 | A1* | 7/2014 | Ahmed | A61G 7/053 4/237 |
| 2014/0352050 | A1* | 12/2014 | Yao | A47K 11/04 4/483 |
| 2017/0105891 | A1* | 4/2017 | He | A61G 5/128 |
| 2018/0271334 | A1* | 9/2018 | Hart | A61G 7/1034 |
| 2018/0271335 | A1* | 9/2018 | Hart | A61G 7/1034 |
| 2019/0159633 | A1* | 5/2019 | Lee | A47K 3/022 |
| 2020/0060904 | A1* | 2/2020 | Sonoda | A61G 5/1002 |
| 2020/0093665 | A1* | 3/2020 | Schwab | A47K 13/10 |

* cited by examiner

FOLDABLE MULTI-PURPOSE WHEELCHAIR

BACKGROUND OF THE INVENTION

1. Field of the Invention

The present invention relates generally to wheelchair for elderly or physically impaired individuals; and particularly relates to a foldable multi-purpose wheelchair that can also be employed as a shower chair or as a toilet chair, when needed.

2. Description of the Related Art

Elderly people and persons suffering from any kind of physical impairment need support for movement from one location to another and may also require seating furniture for bathrooms in different situations, like using a toilet or taking a shower. Similarly, in hospitals and nursing homes, any patient who may be immobile due to some physical condition would also need assistance of such medical equipment for performing the said tasks. Often for each of these endeavors, some specialized medical appliances are deigned and provided to the user. For example, for transporting the user, say to the bathroom for taking a shower or using toilet, may require use of a wheelchair or a walker; whereas for using a toilet may require use of special furniture like a seat designed to be placed over toilet seat; and similarly for taking shower may require the use of a stool or the like.

The problem with currently available equipment for such purposes, especially said specialized furniture for bathrooms and toilets is that those are typically supplied with rigidly mounted legs or with separately supplied legs. This situation has the disadvantage that these products require a lot of space during transport, or otherwise such products need to be assembled and disassembled by the customer with tools. Generally, when the seating furniture is stored because it is not needed, it again occupies a lot of space. Moreover, there is additional space needed by the wheelchair which is generally required to be always handy for transporting the user from one place to another. Handling of all such equipment may be a hassle for the user and the care-taker.

Some attempts have been made in the prior-art to mitigate such issues. For example, there have been attempts to provide equipment which can act as a walker while can also be used for toilet purposes, and in some cases can allow a user to take shower as well while sitting thereon. For instance, U.S. Pat. No. 3,123,398A ('398 patent) relates to portable chairs adapted for use by patients in hospitals and similar places for transporting the patient to a shower in the process of bathing the patient. More particularly, the '398 patent deals with a chair of the character defined, wherein the various frame parts or components of the chair are constructed of rustproof materials to render long service and, particularly, wherein the fabric back support is movable on the backrest frame for and complete exposure of the back of the patient during the process of bathing a patient and, wherein, the chair is of such structure as to facilitate convenient positioning of the chair over a standard toilet.

However, the chair as disclosed in the '398 patent may still suffer from the problem of occupying large space. Therefore, there is a need to an equipment that could combine the functioning of various appliances for supporting a user into a single design for accomplishing the task as described above, while still being portable for easy storage when not needed. Documents describing the closest subject matter provide for a number of more or less complicated features that fail to solve the problems described above in an efficient and economical way. None of the documents suggest the novel features of the present invention.

SUMMARY OF THE INVENTION

It is one of the objectives of the present invention to provide a wheelchair which can provide functioning of both a toilet seat as well as a shower seat for a user.

It is another objective of the present invention to provide a wheelchair which is foldable and portable so it can be carried easily from one place to another (e.g. during travel), if required.

It is yet another objective of the present invention to provide a wheelchair which is simple in design so it can be easily utilized (e.g. for folding thereof) by the user and/or the care-taker, while being inexpensive to manufacture and steady in construction.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
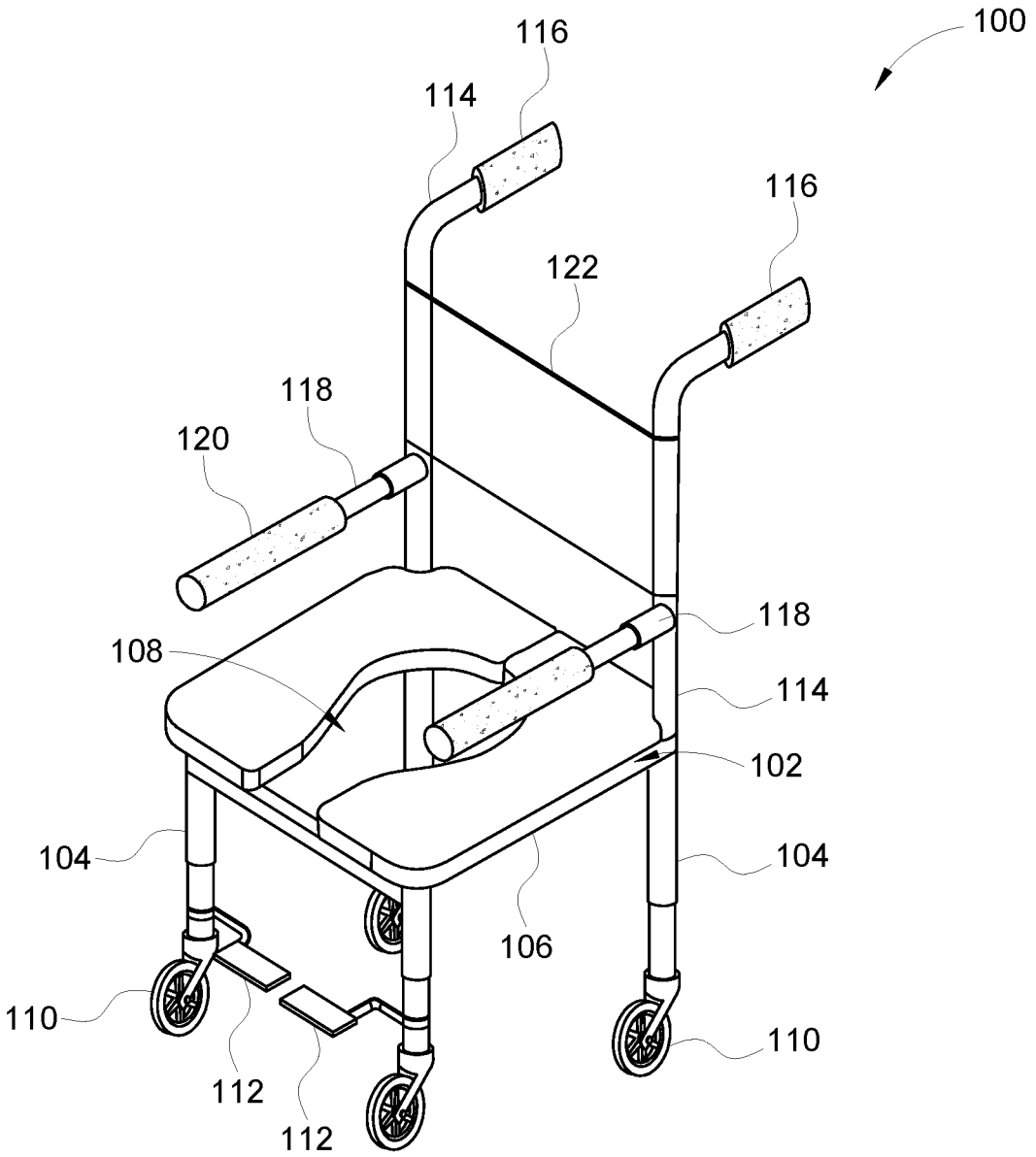
FIG. 1 illustrates a diagrammatic perspective view of a wheelchair 100 in its accessible configuration, in accordance with one or more embodiments of the present invention.
Figure 2:
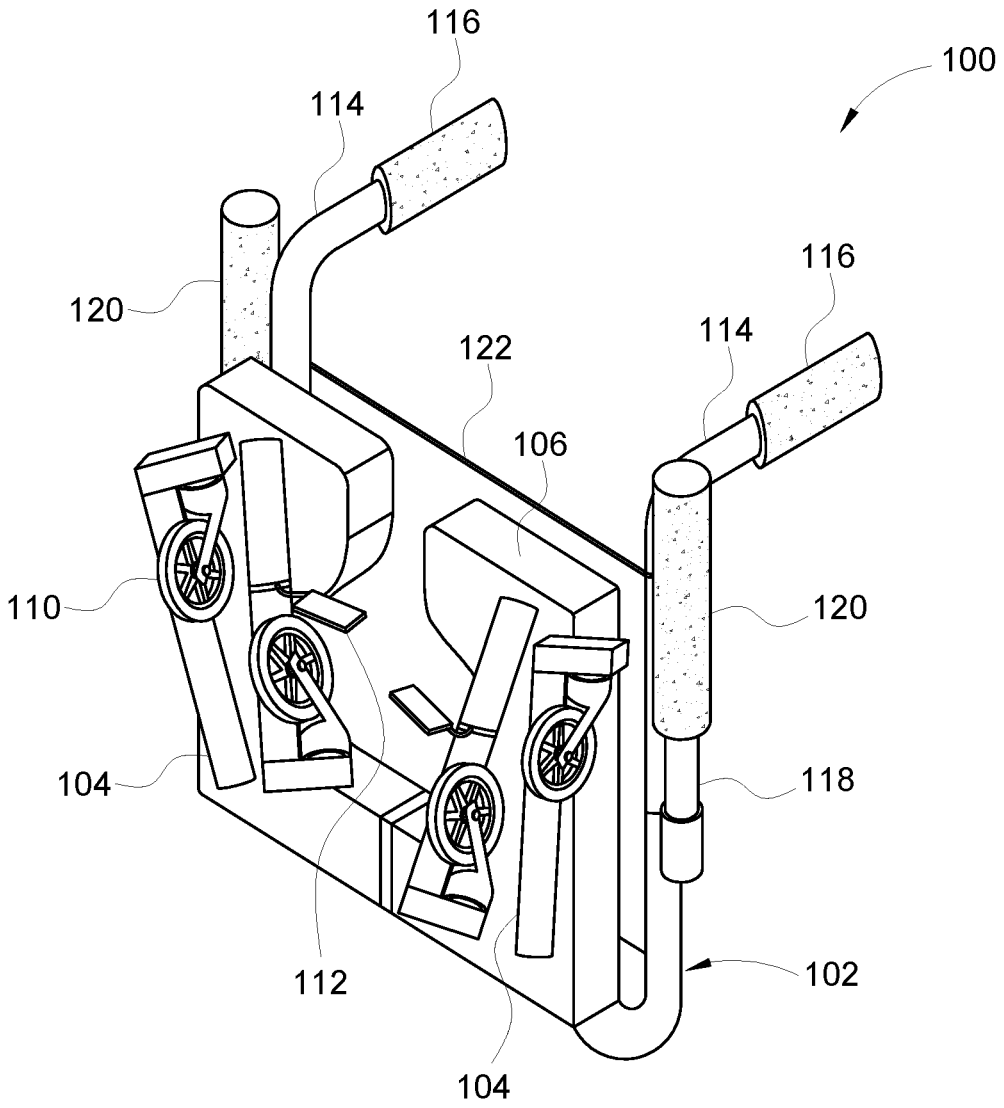
FIG. 2 illustrates a diagrammatic perspective view of the wheelchair 100 in its folded configuration thereby defining a collapsible configuration, in accordance with one or more embodiments of the present invention.

Referring to the drawings, FIGS. 1-2 illustrate diagrammatic perspective views of a wheelchair (generally designated by the numeral 100), in accordance with one or more embodiments of the present disclosure. In particular, FIG. 1 illustrates the wheelchair 100 in its accessible configuration, and FIG. 2 illustrates the wheelchair 100 in its folded configuration. The wheelchair 100 is designed to be used for transporting a user, say to the bathroom for taking a shower or using the toilet, while it can also facilitate the user to use the toilet seat as well as can act as a piece of furniture for supporting the user to take shower. Herein, the "user" refers to a person such as a sick patient, an elderly or a handicapped person who needs to use a wheelchair for travel between two distant places, like from bedroom to the bathroom. The wheelchair 100 of the present invention is designed for easy movement and for enhancing storage capabilities, and is inexpensive, dependable and fully effective in accomplishing its intended purposes, as would be clear from the following description.

As better illustrated in FIG. 1, the wheelchair 100 includes a tubular frame 102. For the purposes of the present invention, the frame 102 may be made of strong yet light-weight materials which may also be water-proof to preventing corrosion thereof. The frame 102 may be sized to provide for easy access and egress of the wheelchair 100 to and from bathrooms. As shown, the frame 102 includes four legs 104, with one pair of front legs and one pair of rear legs. As may be seen, the legs 104 are also generally tubular in structure so as to be easily adjustable. Further, the frame 102 provides a base onto which a seat 106 is mounted. The seat 106 has a design similar to that of a split toilet seat, in which the seat has an opening 108 at its front end. Such construction of the seat for toilet seat use is known in the art and thus have not been described further herein for the brevity of the present disclosure.

It may be appreciated that the legs 104 may generally have a height sufficient to clear the top of the toilet seat to generally place the seat 106 above thereof. In one or more examples, the legs 104 may be telescopic so as to adjust height of the wheelchair 100 as required, for example depending on the height of the toilet seat. Further, in some examples, the seat 106 may be provided with a lid or the like which may be mounted to a back end of the base of the frame 102, such that the lid could be pulled down to provide more aesthetically pleasing arrangement when the wheelchair 100 is being utilized as a walker in public or similar situations, and also provides a more comfortable seat for the user.

The wheelchair 100 of the present invention may also include wheels 110 which are provided below each of the legs 104 of the frame 102 therein to facilitate movement. In one or more examples, the wheels 110 may be caster wheels which are well known in the art. In other examples, the wheels 110 may be of some other suitable type such as roller wheels without any limitations. Further, the wheelchair 100 may include a pair of foot-rests 112 which may be provided along with the front pair of legs 104. The foot-rests 112 may be mounted onto the front pair of legs 104 using a fastener or the like. As may be seen, the foot-rests 112 may generally be located towards lower end of the legs 104. The foot-rests 112 generally provide a flat surface to allow the user to place his/her feet thereon and provide support thereto, while using the wheelchair 100.

Further, as illustrated in FIG. 1, the frame 102 includes support members 114 which may be extending above the seat 106. In the present examples, the support members 114 may be tubular inverted L-shaped members. In some examples, the support members 114 may be provided with grips 116 which can be used by a care-taker or the like to grasp and push or pull the wheelchair 100, as needed. Also, the frame 102 includes armrests 118 which may be extending generally horizontally along a longitudinal direction of the wheelchair 100, from the support members 114. The armrests 118 allow the user to support his/her arms thereon, while using the wheelchair 100. In some examples, the armrests 118 may be provided with cushions 120 to allow the user to comfortably place his/her arms thereon.

Further, the wheelchair 100 includes a back support 122. In one or more examples, the back support 122 may be a rigid structure or a piece cloth depending on the design requirement and/or preference of the user. For example, the back support 122 may be made of meshed Nylon® fabric. The meshed fabric provides the user with air to prevent sweating around back of the user, while using the wheelchair 100. In case of use of such fabric material, the back support 122 can simply be slid down along the support members 114 of the frame 102, and then adjusted and fixed at a certain height according to the requirement of the user.

As discussed, FIG. 2 illustrates the present wheelchair 100 in its folded configuration, which can allow for easy storing. In the present embodiments, with the wheelchair 100 being foldable, the legs 104 may be connected to the base in a pivotal manner, such that the legs 104 may be folded about the seat 106 in the folded configuration of the wheelchair 100, as shown in FIG. 2. It may be understood that for achieving the folding of the legs 104, the corresponding front and rear legs 104 may be arranged on the base of the frame 102 in a staggered manner so that any of the two legs may not hinder the folding of the other one. Further, in a similar manner, each of the wheels 110 and the foot-rests 112 may be pivotally coupled or mounted with the respective legs 104 in order to be folded against the corresponding leg 104 and thereby be disposed generally in line with respect to the legs 104 in the folded configuration of the wheelchair 100, as shown in FIG. 2. Furthermore, it may be seen from FIG. 2, the base may be pivotally connected with respect to the support members 114 such that the entire seat 106 can be folded against the back support 122 to be in generally parallel and planar relationship therewith in the folded configuration of the present wheelchair 100.

For folding the wheelchair 100, first the wheels 110 and the foot-rests 112 may be folded against the legs 104, then the legs themselves can be folded-in against the seat 106, further the armrests 118 can be folded to be disposed along sides of the support members 114, and thereafter the seat 106 can be folded against the back support 122. Due to the frame 102 being made of light-weight materials, the entire folding process can be carried out by a single individual, like the care-taker, in a matter of minutes.

According to one embodiment, the wheelchair 100 may have a total height of about 41 inches, a longitudinal length of about 19.5 inches and a traverse length of about 17.5 inches. Herein, the seat 106 may be about 17.5 inches by 17.5 inches in dimensions. Further, the frame 102 of the wheelchair 100, along with the legs 104, may be made of PVC or aluminum. The wheelchair 100 of the present invention is a multi-purpose equipment or appliance combining functioning of a walker, a toilet seat support, and a shower furniture, which is particularly helpful for elderly and disabled persons. The wheelchair 100 can be folded into a compact shape, as shown in FIG. 2, for ease of travel and storage. In some examples, the wheelchair 100 can be folded into compact shape to be fitted into travel luggage or back of a vehicle with ease.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense in any manner.

What is claimed is:

1. A multi-purpose wheelchair, comprising:

a tubular frame;

two support members pivotally mounted and extending upwardly from the tubular frame;

four legs pivotally mounted and extending downwardly from the tubular frame, each leg pivotably mounted from the tubular frame independently from the other legs;

four wheels arranged such that one wheel is provided with each of the four legs;

a split-seat with an opening supported on the tubular frame;

and a back support extending between the two support members.

2. The wheelchair of claim 1, wherein the four legs are arranged to provide a pair of front legs and a pair of rear legs.

3. The wheelchair of claim 2 further comprising two foot-rests such that one of the two foot-rests is pivotally mounted on one of the two legs in the pair of front legs.

4. The wheelchair of claim 3, wherein the foot-rests are located towards lower end of the front legs.

5. The wheelchair of claim 2, wherein the pair of front legs is arranged and extending in a staggered manner with respect to the pair of rear legs from the tubular frame.

6. The wheelchair of claim 1, wherein the support members are generally inverted L-shaped members.

7. The wheelchair of claim 6, wherein the support members are provided with grips to be used by a person to grasp for pushing or pulling the wheelchair.

8. The wheelchair of claim 1 further comprising two armrests such that each of the two armrests extends horizontally from one of the two support members.

9. The wheelchair of claim 8 further comprising a cushion provided with each of the armrests to allow a user to comfortably place his/her arms thereon.

10. The wheelchair of claim 1, wherein the back support is made of mesh Nylon® fabric.

11. The wheelchair of claim 1, wherein the legs are tubular in structure.

12. The wheelchair of claim 1, wherein the wheels are caster wheels.

13. The wheelchair of claim 1, where said wheelchair can be stored in a folded configuration.

* * * * *